US005460095A

United States Patent [19]

Slagle et al.

[11] Patent Number: 5,460,095

[45] Date of Patent: Oct. 24, 1995

[54] MOUNTING APPARATUS FOR EXPENDABLE BAR CARRIER SHAPED-CHARGES

[75] Inventors: Terry L. Slagle, Houston; Girven R. Kissell, Pampa, both of Tex.

[73] Assignee: Western Atlas International, Inc., Houston, Tex.

[21] Appl. No.: 365,778

[22] Filed: Dec. 29, 1994

[51] Int. Cl.[6] ..... F42B 1/02; F42B 3/00; F42D 1/08

[52] U.S. Cl. ..... 102/307; 102/310; 102/476; 102/313; 86/21; 175/4.6

[58] Field of Search ..... 102/307, 310, 102/476, 312, 313; 86/21; 175/4.6

[56] References Cited

U.S. PATENT DOCUMENTS

| | | | |
|---|---|---|---|
| 2,043,340 | 6/1936 | Tilbury et al. | 86/21 |
| 2,839,997 | 6/1958 | Church et al. | 102/307 X |
| 4,655,138 | 4/1987 | Regalbuto et al. | 102/307 X |
| 4,889,183 | 12/1989 | Sommers et al. | 175/4.6 X |
| 5,007,486 | 4/1991 | Ricles | 175/4.6 X |
| 5,095,999 | 3/1992 | Markel | 102/310 X |

*Primary Examiner*—Peter A. Nelson
*Attorney, Agent, or Firm*—Richard A. Fagin

[57] ABSTRACT

The invention is a lid for a shaped charge which enables application of torque to the shaped charge for mounting in an expendable bar carrier borehole penetrating gun assembly. The lid comprises a plurality of flat surfaces facially parallel with the axis of a threaded stud forming part of the lid, the stud engaging mating threads in a hole in the carrier. The flat surfaces are arranged around the circumference of the lid so that a wrench or socket can be used to apply torque to the lid for mounting in the carrier. Each juncture of two contiguous ones of the flat surfaces includes a score line extending substantially perpendicular to the axis of the stud.

In a preferred embodiment of the invention each juncture includes a crimp on part of the juncture on a side of the score line opposite to the stud, to retain the lid on the charge.

The invention is also an apparatus for simultaneously torquing a plurality of shaped charged in a bar carrier. Each of the shaped charges comprises the charge lid of the invention. The apparatus includes a plurality of wrench sockets, corresponding final drives coupled to the sockets, an intermediate drive coupled to all of the final drives, and a motor to turn the intermediate drive, all mounted in a frame. The final drives are coupled to the intermediate drive to cause all the sockets to rotate in the same direction. Positioning the frame to enable the sockets each to engage a shaped charge will cause all the charges to be torqued simultaneously.

9 Claims, 2 Drawing Sheets

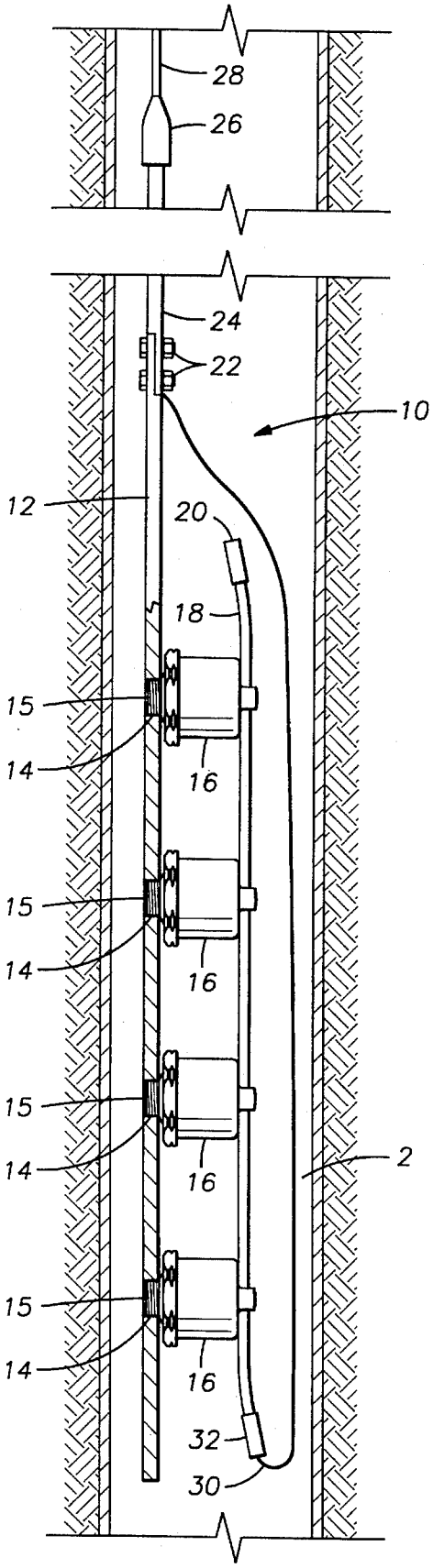
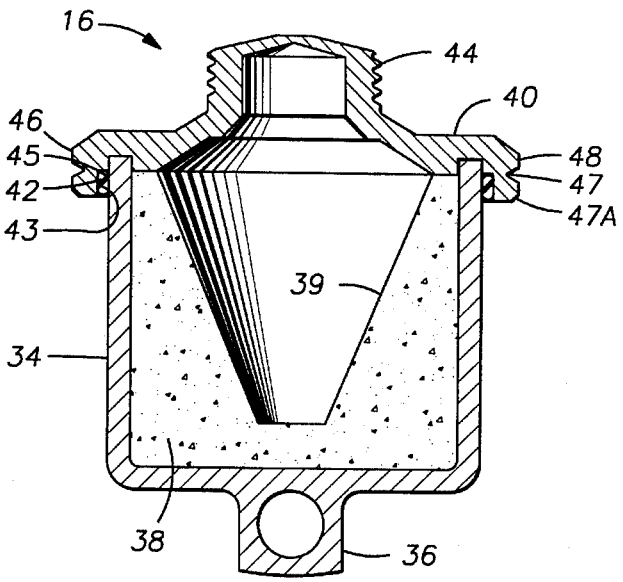
FIG. 2
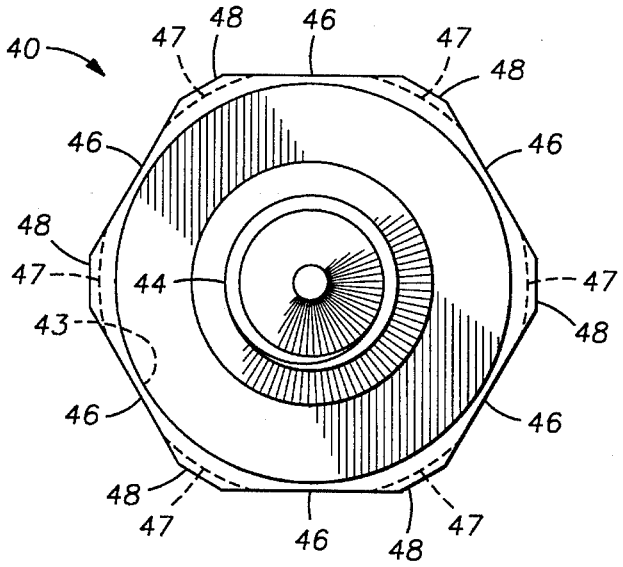
FIG. 3
FIG. 1

MOUNTING APPARATUS FOR EXPENDABLE BAR CARRIER SHAPED-CHARGES

BACKGROUND OF THE INVENTION

1. Field of the Invention

The present invention is related to the field of high-explosive shaped charges. More particularly, the present invention is related to a design for the exterior cover or lid of a shaped charge used for perforating earth boreholes having protective pipe, or casing.

2. Discussion of the Related Art

High-explosive shaped charges are commonly used to create hydraulic communication passages, called perforations, in a protective pipe, or casing, used in completing a borehole penetrating an earth formation. The charges are typically conveyed to a depth of interest in a borehole by means of wireline or pipe.

It is often desirable to create a plurality of perforations in the casing all at one time, so various devices have been devised for conveying a plurality of charges to the depth of interest. The devices are known as gun assemblies, or guns. Some guns are of a type known as fully-expendable, a term used to describe a type of gun which enables recovery of substantially no useful components of the gun after detonation of the charges.

One type of fully expendable gun assembly is known as an expendable barcarrier. Compared with some other types of guns sized to enable transport through a tubing string which may be coaxially inserted within the casing, expendable bar carriers have the advantages of: enabling transport of larger charges in the gun assembly; and enabling recovery of greater amounts of expended charge debris after detonation of the gun.

Expendable bar carrier gun assemblies typically comprise shaped charges which are sealed to exclude fluids which may be present in the borehole before detonation of the gun. The sealing means typically includes a housing containing the explosive, and a lid disposed on the side of the charge from which the explosive detonation discharge is expelled. The lid typically has a sealing surface which engages a mating sealing surface in the housing and is sealed by an o-ring or similar seal which enables relative rotation between the lid and the housing. The lid also has a threaded mounting stud for threadedly engaging a carrier.

The carrier is typically an elongated steel bar having a plurality of threaded holes located colinearly at spaced apart locations along the length of the carrier. The holes have threads sized to engage the studs on the charge lids. Typically the carrier will have 4 or 6 threaded holes per foot of carrier length. Carrier lengths can be as short as one foot, or in some cases extend to 100 feet or more when carriers are assembled from sections, typically each section being ten feet long. Some or all of the holes in each carrier can have charges mounted therein on any particular gun assembly, depending on the completion requirements of the particular borehole.

One of the problems encountered with bar carrier guns is that the charge lids typically have a round exterior surface adjacent to the stud, and therefore do not have a suitable surface to which stud mounting torque can be applied. Several specialized tools have been developed to apply mounting torque to the lid, but the available tools have neither a means to measure the applied torque nor a means to mount a plurality of charges simultaneously. Other methods of mounting charges in bar carriers include torquing with pipe wrenches or pliers. Both pliers and pipe wrenches can distort the sealing surface of the charge lid, leading to leakage of the lid when the gun is lowered into the borehole, and consequent possible failure of the charge to detonate correctly.

It is desirable to retain as many lids as possible in the carrier after detonation of the charges, so that the amount of debris left in the borehole as a result of detonating the gun is kept to a minimum. If insufficient mounting torque is applied to the charges, detonation can cause ejection of the charge lids from the carrier.

It is also desirable to mount a plurality of charges in the carrier simultaneously to reduce the gun assembly time. Round lids known in the art make it difficult to use an apparatus which would enable simultaneous torquing of a plurality of charges.

It is an object of the present invention to provide a shaped charge having a mounting surface which enables application of mounting torque without distorting the lid of the charge.

It is a further object of the present invention to provide an apparatus which can apply mounting torque simultaneously to a plurality of shaped charges on an expendable bar carrier borehole perforating gun assembly.

It is yet a further object of the present invention to provide a lid for a shaped charge used in an expendable bar carrier gun assembly which enables improved retention of the lids in the carrier after detonation of the gun assembly.

SUMMARY OF THE INVENTION

The present invention is a lid for a shaped charge adapted to enable application of torque to the shaped charge for mounting the charge in an expendable bar carrier borehole perforating gun assembly. The lid comprises a plurality of flat surfaces which are arranged around the circumference of the lid. The lid also comprises a threaded stud to enable threaded mounting in a mating threaded hole in the bar carrier. The flat surfaces on the lid have exterior faces parallel to the axis of the threaded stud, so that a wrench or socket can be applied to the charge for application of torque to mount the charge in the carrier. Each juncture of two contiguous ones of the flat surfaces includes a score line extending substantially perpendicular to the axis of the stud.

In a preferred embodiment of the invention each juncture includes a crimp on part of the juncture on a side of the score line opposite to the stud, to retain the lid to the charge.

The present invention is also an apparatus for simultaneously applying mounting torque to a plurality of shaped charges on an expendable bar carrier borehole perforating gun assembly. The apparatus includes a plurality of socket wrenches having interior surfaces matching flat surfaces on shaped charge lids, a motor, and a plurality of gears rotationally engaged to the motor and to the plurality of socket wrenches, so that torque exerted by the motor will be applied simultaneously to all the shaped charges.

BRIEF DESCRIPTION OF THE DRAWINGS

FIG. 1 shows the assembly of an expendable bar carrier type borehole penetrating gun.

FIG. 2 shows a shaped charge perforator, including a charge lid according to the present invention.

FIG. 3 shows an end view of the charge lid according to the present invention.

DESCRIPTION OF THE PREFERRED EMBODIMENT

Figure 4:
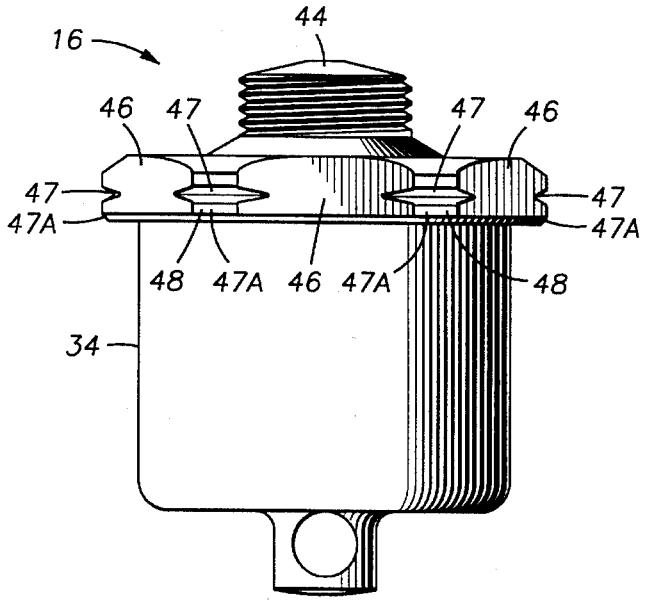
FIG. 4 shows a side view of the charge lid according to the present invention assembled to a shaped charge.

FIG. 1 shows an expendable bar carrier borehole perforating gun assembly 10. An elongated bar carrier 12, typically composed of steel, holds a plurality of shaped charges 16 in threaded holes 14 adapted to engage mating threads formed on mounting studs 15 which form pan of the shaped charge 16. The charges 16 are retained in the holes 14 by thread friction between the studs 15 and the holes 14. The carrier 12 is attached to a firing head 24 by retaining bolts 22. The firing head 24 may be attached at its upper end to other equipment such as a casing collar locator (not shown). Eventually the gun assembly 10 terminates in a cable head 26. The cable head 26 is attached to a wireline 28, which can be used to transport the gun assembly 10 through a borehole 2. The wireline 28 also supplies detonation current through an insulated conductor 30 to an electrically actuated detonator 32 located at the bottom of the gun assembly 10. The detonator 32 initiates a detonating cord 18, which is attached to each of the shaped charges 16, and initiates detonation of the shaped charges 16. The detonating cord 18 typically includes a sealing cap 20 at the end of the cord 18 opposite to the detonator 32, in order to seal out fluids which may be present in the borehole 2.

FIG. 2 shows the charge lid 40 of the present invention as it is assembled to the shaped charge 16. The shaped charge 16 includes: a housing 34 which can have a mounting eye 36 to retain the detonating cord (shown as 18 in FIG. 1); a high explosive charge 38; a liner 39; an o-ring 42; and the lid 40.

The lid 40 comprises a threaded mounting stud 44, which engages mating threads (shown as 14 in FIG. 1) in the carrier (shown as 12 in FIG. 1). The o-ring 42 contacts a sealing surface 43 forming part of the lid 40. The o-ring 42 also contacts a mating sealing surface 45 forming part of the housing 34. The lid 40 is attached to the housing 34 so as to enable rotation of housing 34 relative to the lid 40 when the charge 16 is assembled to the carrier 12. Rotating the housing 34 enables the eye 36 to be arranged coaxially with the carrier 12, to facilitate attachment of the detonating cord 18 to a plurality of charges 16 in the gun assembly 10.

FIG. 3 shows a top view of the lid 40 in order to better show part of the functionality of the invention. A plurality of flat surfaces 46 are arranged around the circumference of the lid 40 opposite to the sealing surface 43. The flat surfaces 46 are facially parallel to the axis of the stud 44, and are arranged in a manner that enables engagement of the flat surfaces 46 by a tool such as an impact wrench socket. The arrangement of the flat surfaces 46 can be similar to the arrangement of flats on a hex machine nut.

By engaging the flat surfaces 46, the wrench socket can apply controllable, measurable torque to the lid 40 to mount the charge 16 in the carrier 12. While FIG. 3 shows the lid 40 as having six flat surfaces 46 arranged in a hexagon, it is contemplated that a different number of flat surfaces 46 can provide the same functionality. For example, impact wrench sockets are also made having twelve mating flat surfaces, so the lid 40 of the present invention could also have twelve flat surfaces 46 arranged to mate with a twelve-point socket.

Torque can be applied to the socket through a wrench which comprises a torque measuring instrument, so the lid 40 of the present invention also enables application of a measurable mounting torque to the charge 16 as previously described herein. Torque can also be applied to a socket using an impact wrench having a calibrated, predetermined torque output, so that charges 16 can be assembled to the carrier 12 without the need for the operator to observe a torque measurement each time a charge 16 is assembled to the carrier 12.

A side view of the lid 40 of the present invention is shown in FIG. 4 to better explain an additional function of the present invention. A juncture, shown at 48, is formed at each intersection of two contiguous ones of the flat surfaces 46. A score line 47 is formed into each juncture 48 and the score line 47 is deep enough to at least partially penetrate the flat surfaces 46. The score lines 47 extend substantially perpendicularly to the axis of the stud 44. Upon detonation of the charge 16, the lid 40 typically fractures along the score lines 47, thereby breaking off the part of the lid 40 in contact with the housing 34. The remainder of the lid 40 remains threadedly fastened to the carrier 12 by means of the stud 44 after detonation of the charge 16.

A portion 47A of each the junctures 48 located on the side of the score line 47 opposite to the stud 44 is crimped inwardly towards the housing 34 during the process of manufacturing the charge 16. The crimping deforms the portions 47A so that they frictionally contact the part of the housing 34 just below the o-ring 42. The frictional contact retains the lid 40 on the housing 34 during insertion of the charges 16 in the carrier 12, and during movement of entire the gun assembly 10 through the borehole 2.

Figure 5:
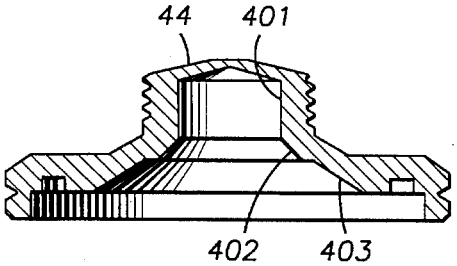
FIG. 5 shows a cross-sectional view of the charge lid according to the present invention

FIG. 5 shows a cross section of the lid 40 according to the present invention in order to better explain features of the lid 40 pertaining to the intended performance of the lid 40 and the penetration performance of the charge 16. Upon detonation of the high explosive (shown as 38 in FIG. 2), superheated gases and particles of metal from the liner are discharged by the detonation in a substantially conical shaped plume called a "jet". The significance of the conical shape of the jet will be further explained.

On an interior surface of the lid 40, located internally to the threaded stud 44 is a cylindrical portion 401 formed so as to reduce the thickness of material which must be penetrated by the jet in order to perforate the borehole (shown as 2 in FIG. 1). A first countersunk portion 402 contacts the exterior diameter of the cylindrical portion 401. The first countersunk portion 402 typically subtends an angle of about 90 degrees, and has an external diameter about equal to the interior thread diameter of the stud 44. The first countersunk portion 402 is shaped so as to reduce the amount of lid material in the path of the conically shaped jet as it is forming, which substantially increases the perforation performance of the charge 16. A second countersunk portion 403 is formed substantially concentrically around the first countersunk portion 402. The second countersunk portion 403 has an internal diameter approximately the same as the exterior thread diameter of the stud 44, and so is radially spaced apart from the first countersunk portion 402. The second countersunk portion 403 can subtend and angle of about 115 degrees, and is formed so as to reduce the amount of lid material in the path of the forming jet. The second countersunk portion 403 is also spaced apart from the first countersunk portion 402 to provide sufficient metal thickness in the lid 40 near the base of the stud 44 to substantially eliminate stress cracking of the lid 40 at the base of the stud 44. By reducing stress cracking at the base of the stud 44, there is a much higher probability that the lid 40 can be retained in the carrier (shown as 12 in FIG. 1) upon detonation of the charge 16.

It is contemplated that other subtended angles and aliametric dimensions of the first 402 and second 403 countersunk portions would accomplish the same objectives of maximizing perforation performance and reducing stress cracking as those angles and dimensions described in the present embodiment of the invention. The angles and diametric dimensions disclosed herein were determined to be functional by means of experimental detonation of actual charges 16 having lids 40 formed as described herein.

Figure 6:
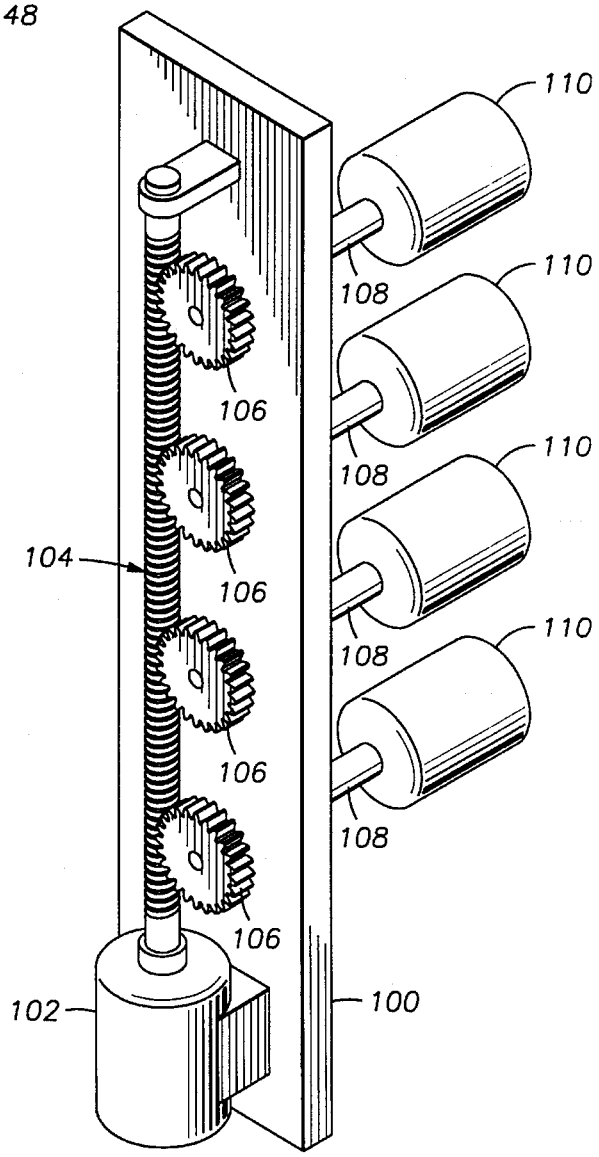
FIG. 6 shows an apparatus used to torque a plurality of charges on an expendable bar carrier simultaneously.

FIG. 6 shows an apparatus which can be used to simultaneously torque a plurality of charges 16 in the carrier 12. A plurality of wrench sockets 110 is attached to a plurality of drive shafts 108. Each of the drive shafts 108 is individually connected to a plurality of corresponding gears 106, each gear being rotatably mounted in a frame 100. The gears 106 can be radially spaced the same distance as the distance between holes (shown as 14 in FIG. 1) in the carrier 12. Each of the gears 106 is in operative contact with a worm shaft 104. The worm shaft 104 is driven by a motor 102, which in this embodiment can be an electric motor. Operation of the motor 102 turns the worm shaft 104, which then rotates the plurality of gears 106 all in the same direction. Rotation of the gears 106 is transmitted to the shafts 108 and sockets 110. The frame 100 can be positioned so that each socket 110 fits over a shaped charge 16 in the carrier 12, thereby enabling simultaneous torquing of a plurality of shaped charges 16.

What is claimed is:

1. A lid for a perforating shaped charge, comprising:

a threaded stud having an axis, said stud located substantially in the center of said lid and extending outwardly therefrom;

a plurality of flat surfaces circumscribingly arranged on an external diameter of said lid, said flat surfaces facially parallel with said axis so that torque can be applied to said lid with a wrench, said flat surfaces forming a juncture at each intersection of two contiguous ones of said flat surfaces; and a score line penetrating at least partially through said flat surfaces at each of said junctures, said score line extending substantially perpendicularly to said axis of said stud, so that said lid is substantially completely disengaged from said charge upon detonation of said charge.

2. The lid as defined in claim 1 further comprising a crimp formed in each one of said junctures on a side of said score line located opposite to said stud so that said lid remains attached to said charge until said charge is detonated.

3. The lid as defined in claim 1 further comprising:

a first countersunk portion formed substantially centrally into an interior surface of said lid, said first countersunk portion having an inner diameter substantially the same as a cylindrical portion formed into said interior surface inside said threaded stud, said first countersunk portion having an outer diameter approximately equal to an interior threaded diameter of said threaded stud; and a second countersunk portion formed substantially centrally into said interior surface of said lid, said second countersunk portion having an inner diameter substantially the same as said interior threaded diameter of said threaded stud, said second countersunk portion subtending an angle substantially greater than an angle subtended by said first countersunk portion so that said lid is substantially prevented form cracking near a base of said threaded stud and penetration performance of said charge is not substantially altered by inclusion of metal from said lid into a detonation pattern of said charge.

4. The lid as defined in claim 1 wherein said plurality of flat surfaces numbers 6, each of said plurality of flat surfaces is of substantially equal length, and said plurality of flat surfaces is arranged in a substantially regular hexagon.

5. The lid as defined in claim 1 wherein said plurality of flat surfaces numbers 12 each of said flat surfaces is of substantially equal length, and said plurality of flat surfaces is arranged in a substantially regular dodecagon.

6. An apparatus for simultaneously applying mounting torque to a plurality of high explosive shaped charges forming part of an expendable bar carrier borehole perforating gun assembly, said apparatus comprising:

a frame;

a motor, disposed within said frame;

an intermediate drive, disposed within said frame and rotationally coupled to said motor;

a plurality of final drives, rotationally coupled to said intermediate drive so that each of said plurality of final drives rotates in the same direction; and a plurality of wrench sockets, each of said plurality of sockets having an interior surface adapted to mate to an exterior surface of each of said plurality of shaped charges, each of said plurality of wrench sockets rotationally coupled to each of said plurality of final drives, said plurality of wrench sockets arranged coaxially and colinearly with said plurality of shaped charges partially threadedly engaged to said carrier, so that when said frame is positioned to enable engagement of said plurality of sockets with said plurality of said charges, activation of said motor causes torque to be applied simultaneously to said plurality of shaped charges.

7. The apparatus as defined in claim 6 wherein said intermediate drive comprises a worm gear.

8. The apparatus as defined in claim 6 wherein said plurality of final drives comprise a plurality of spur gears, and a plurality of drive sharks correspondingly coupled to said plurality of spur gears.

9. A perforating gun assembly for a wellbore, comprising:

a carrier having at least one threaded hole to mount a shaped charge therein;

at least one shaped charge having a housing and a lid, said lid including a threaded stud having an axis and extending substantially outwardly from a center of said lid, said stud adapted to engage said at least one threaded hole in said carrier, and said lid comprising a plurality of flat surfaces arranged circumscribingly around an external diameter of said lid, said surfaces substantially facially parallel to said axis of said stud, said surfaces further including junctures formed at each intersection of each two contiguous ones of said surfaces, each of said junctures having a score line thereon extending substantially perpendicular to said axis of said stud, each of said junctures having a crimp on a side of said score line opposite said stud so that said lid is retained during transport of said gun through a tubing in said wellbore and said lid is substantially completely disengaged from said charge and retained in said carrier upon detonation of said charge.

* * * * *